United States Patent [19]

Imaeda

[11] Patent Number: 5,019,873

[45] Date of Patent: May 28, 1991

[54] COLOR TONE ADJUSTABLE IMAGE RECORDING APPARATUS

[75] Inventor: Mikio Imaeda, Bisai, Japan

[73] Assignee: Brother Kogyo Kabushiki Kaisha, Aichi, Japan

[21] Appl. No.: 429,002

[22] Filed: Oct. 30, 1989

[51] Int. Cl.[5] ..... G03G 15/01

[52] U.S. Cl. ..... 355/326; 355/35

[58] Field of Search ..... 385/326, 327, 204, 208, 385/35, 32, 88

[56] References Cited

U.S. PATENT DOCUMENTS

| | | | |
|---|---|---|---|
| 4,104,069 | 8/1978 | Vanheerentals et al. | 355/68 X |
| 4,182,560 | 1/1980 | Oguchi et al. | 355/35 X |
| 4,641,959 | 2/1987 | Terashita | 355/38 X |
| 4,809,198 | 2/1989 | Terashita | 355/38 X |
| 4,860,059 | 8/1989 | Terashita | 355/208 X |

FOREIGN PATENT DOCUMENTS

| | | | |
|---|---|---|---|
| 0221767 | 10/1986 | Japan | 355/326 |
| 0273588 | 11/1987 | Japan | 355/327 |
| 0125055 | 5/1988 | Japan . | |

*Primary Examiner*—A. T. Grimley
*Assistant Examiner*—Nestor R. Ramirez
*Attorney, Agent, or Firm*—Oliff & Berridge

[57] ABSTRACT

A color image recording apparatus for recording a color image using a photosensitive recording medium, wherein the photosensitive recording medium is exposed to at least two light components different in wavelength from each other to superposedly form a latent image thereon. The latent image is developed to provide the color image. In order to separately adjust a hue and a density of the image to be reproduced, a density setting dial and a hue setting dial are provided for setting a desired density and a desired hue. A table memory stores information regarding exposure amounts of each of red, green and blue lights relative to hues in the range selectable by the hue setting dial. The table memory further stores information regarding total exposure amonts relative to the densities in the range selectable by the desnity setting dial. An exposure amount arithmetic circuit determines an exposure amount for each of the light components corresponding to the hue and the density set by those dials in accordance with the information stored in the table memory.

17 Claims, 8 Drawing Sheets

COLOR TONE ADJUSTABLE IMAGE RECORDING APPARATUS

BACKGROUND OF THE INVENTION

The present invention relates to a color image recording apparatus, and more particularly to an improvement of a color image recording apparatus in which a density and a hue of the image to be reproduced are adjustable.

Various types of color image recording apparatuses have been known in the art, such as of a silver chloride photographic type, an electrophotography type, an ink jet type. In such recording apparatuses, a photosensitive recording medium is exposed to image light to form a latent image thereon, and the latent image is developed to provide a visible image. In color image recording apparatuses, the photosensitive recording medium is successively exposed to light components having wavelengths corresponding to red (R), green (G) and blue (B), thereby superposedly forming latent images thereon. The latent image is thereafter developed to provide a color image thereon. The density of the reproduced color image is determined depending on the amounts of three primary colors including yellow (Y), magenta (M), and cyan (C), or depending further on the amount of black pigment or black dye is used together with the three primary colors. The hue of the reproduced color image is determined depending on the balance or ratio of the colors. Therefore, the color image can be reproduced with desired density and hue by varying each amount of the three primary colors.

When it is desired that the density of the entire color image be lowered, the amounts of three primary colors may be lowered at a time. Further, when it is desired that the hue of the image be changed to, for example, reddish while remaining the entire image density unchanged, the amounts of magenta and yellow may be increased whereas the density of cyan may be lowered.

In the conventional color image recording apparatuses, density adjusting dials are provided which can individually adjust the amounts or densities of the three colors. With such dials, the user adjusts the respective densities of the colors prior to making color copies.

However, it is difficult to obtain color copies of intended density and tone in the case where the respective densities of the primary colors are separately adjusted. To obtain a desired color copy, test copying needs to be carried out repeatedly while varying the respective dials until the copy is found to be satisfactory.

In the case where the color copying machine is used in homes as a video printer in conjunction with a television or a video tape recorder, it is necessary that the users including housekeepers and children be readily adjust the density and the hue.

SUMMARY OF THE INVENTION

The present invention has been made in view of the foregoing, and it is an object of the invention to provide a color image recording apparatus in which the density and hue of the image to be reproduced can be readily adjusted.

The above and other objects of the invention is attained by the provision of a color image recording apparatus for recording a color image using a photosensitive recording medium, wherein the photosensitive recording medium is exposed to at least two light components differing in wavelength to superposedly form a latent image thereon and the latent image is developed to provide the color image having a hue and a density, the hue of the color image being varied depending on an exposure amount by each of the light components and the density of the color image being varied depending on a total exposure amount by the light components, the apparatus comprising means for selecting a hue from a first variable range and a density from a second variable range, storage means for storing information regarding exposure amounts of each of the light components relative to hues in the first variable range and densities in the second variable range, means for determining an exposure amount for each of the light components corresponding to the hue and the density selected by the selecting means according to the information stored in the storage means; and control means responsive to the exposure amount determined by the determining means for controlling the exposure amount of each of the light components applied to the photosensitive recording medium.

The storage means comprises a first table memory storing first information regarding a relation between a total exposure amount of the light components applied to the photosensitive recording medium and the densities in the second variable range, and a second table memory storing second information regarding a relation between the exposure amount of each of the light components and the hues in the first variable range.

When the user separately selects a desired density and a desired hue of the image to be recorded by the selecting means, the determining means determines the exposure amount of each of the light components based on the first and second information stored in the storage means and outputs the exposure amount thus determined to the control means. The control means then control the exposure amount of each of the light components so that the total exposure amount determined based on the first formation is equal to the sum of the exposure amounts of the light components determined based on the second information.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Figure 1:
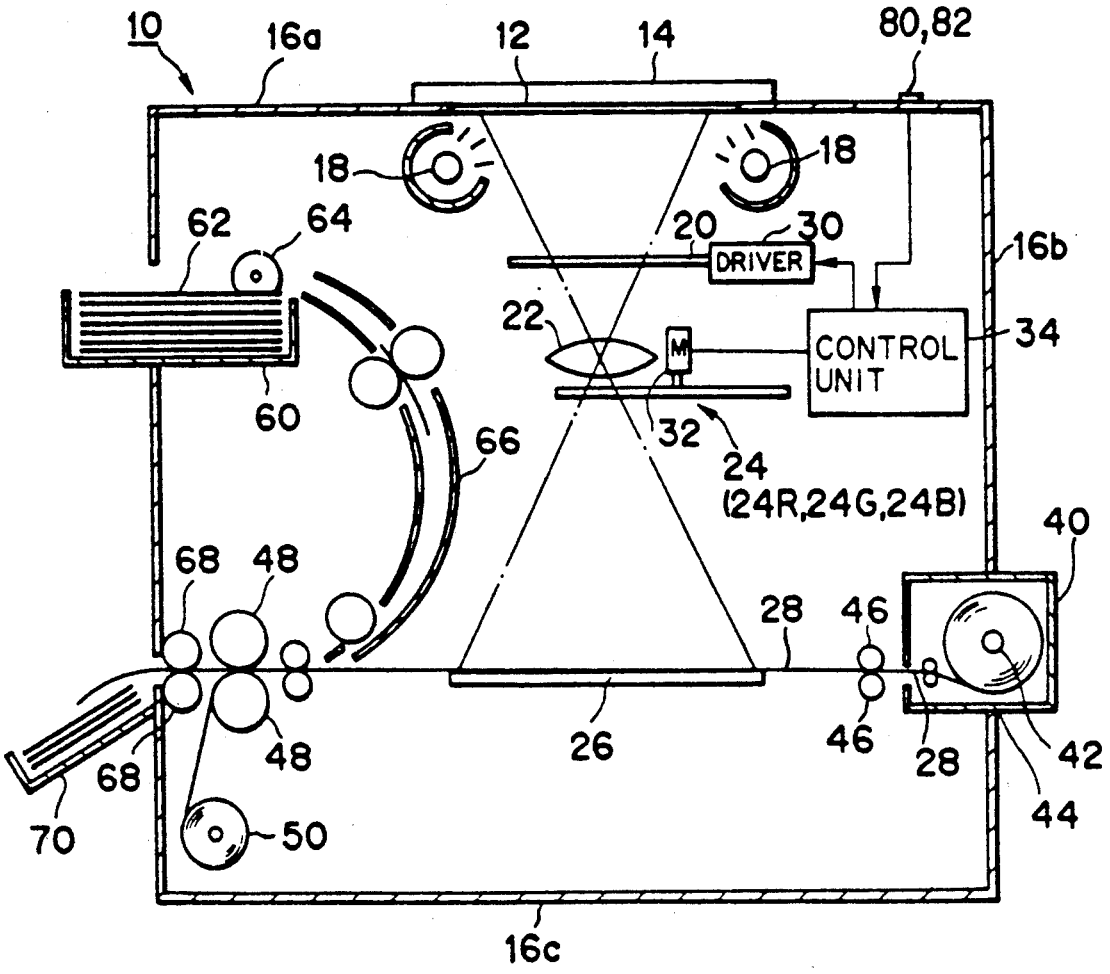
FIG. 1 is a vertical cross-sectional view showing a color copying machine according to the present invention.

FIG. 1 shows one example of a color copying machine 10 capable of performing color copying with the use of a photosensitive, pressure sensitive recording medium, such as microcapsule sheet as disclosed in Japanese Laid-Open Patent Publication No. 58-88739.

Briefly, the microcapsule sheet has a substrate on which an immense number of microcapsules are coated which separately encapsulate cyan, magenta and yellow chromogenic materials as primary components. Each microcapsule further encapsulates therein a photo-curing resin, a photosensitizer, a photopolymerization initiator, etc. The microcapsules are selectively photocured (or photo-softened) when exposed to light to form a latent image thereon. A developer sheet is used in conjunction with the microcapsule sheet, which has a surface coated with a developer material. The exposed microcapsule sheet and the developer sheet are brought into facial contact with each other to develop the latent image under pressure. By the pressure development, the chromogenic material is released from the ruptured microcaspule and reacts with the developer material, thereby forming a visible image on the developer sheet.

The copying machine 10 has an housing defined by a upper frame 16*a*, side frames 16*b* and a bottom frame 16*c*. An original support pane 12 and a hinged cover 14 are mounted at the upper frame 16*a*. An original document to be copied is placed on the original support pane 12 face down, and the cover 14 is closed so that the original document is brought into intimate contact with the face of the original support pane 12.

A pair of lamps 18, 18 are disposed below the original support pane 12 for irradiating lights onto the original document. The pair of lamps 18, 18 are disposed in spaced apart relation with each other so that the entire face of the original document may be uniformly irradiated by the lights from the lamps 18, 18.

Below the lamps 18, 18, a shutter 20, a focusing lens 22 and a filter unit 24 are arranged in the stated order, so that the lights reflected from the original document are passed therethrough and applied to the microcapsule sheet 28 placed over an exposure stand 26. The shutter 20 is connected through a shutter driver 30 to a control unit 34 and is subjected to open/closure control by the control unit 34. When the shutter 20 is opened, the reflected light from the original document is allowed to pass therethrough whereas when it is closed, the reflected light is interrupted.

The filter unit 24 is of a disk-like shape and includes a red filter segment 24R allowing to pass only a red light, a green filter segment 24G allowing to pass only a green light, and a blue filter segment 24B allowing to pass only a blue light. The disk-like filter unit 24 has a rotation center fixedly secured to the rotation shaft of a stepper motor 32 which is in turn connected to the control unit 34. The rotational angles of the stepper motor 32 are controlled by the control unit 34 to selectively position the filter segments in an optical path or in the position immediately below the lens 22.

The microcapsule sheet 28 is rolled about the shaft 42 of a cartridge 40 and accommodated in the cartridge 40. The cartridge 40 is detachably mounted in a socket 44 formed in the right side frame 16*b*. An opening is formed in the left lower portion of the cartridge 40, from which the microcapsule sheet 28 is drawn out and connected to the shaft of a take-up roller 50 while passing through feed rollers 46, 46, the exposure stand 26, and pressure developing rollers 48, 48.

The microcapsule sheet 28 is drawn out from the cartridge with the microcapsule-coated surface up and is temporarily held stationary on the exposure stand 26. In this condition, the microcapsule sheet 28 is exposed to light to form a latent image corresponding to a color image of the original.

Specifically, when the microcapsule sheet 28 is held on the exposure stand 26, the lamps 18 are lit and lights emitted from the lamps 18 are irradiated onto the original. The control unit 34 controls the shutter driver 30 to close the shutter 20. The reflected light from the original is thereby interrupted to pass through the shutter 20. The control unit 34 then controls the stepper motor 32 to position the red filter segment 24R immediately below the lens 22. In this condition, the control unit 34 controls the shutter driver 34 so that the shutter 20 is opened for a first predetermined period of time to allow the reflected light to be applied onto the microcapsule sheet 28. As a result, a red latent image is formed on the microcapsule sheet 28.

Next, the control unit 34 controls the stepper motor 32 to position the green filter segment 24G below the lens 22. In this condition, the shutter 20 is opened for a second predetermined period of time. The microcapsule sheet 28 is thereby exposed to light having a wavelength corresponding to green and is formed with a green latent image in superposed relation with the red latent image. Likewise, the control unit 34 controls the stepper motor 32 to position the blue filter segment 24B below the lens 22, and the shutter 20 is opened for a third predetermined period of time. The microcapsule sheet 28 is exposed to light having a wavelength corresponding to blue and is formed with a blue latent image in superposed relation with the red and green latent images.

In this manner, the red, green and blue latent images are superposedly formed on the microcapsule sheet 28, where each latent image has been formed thereon by applying thereto an amount of light relevant to the color. Then, the microcapsule sheet 28 moves leftwardly.

A cassette 60 is detachably mounted in the left side frame 16*b* above pressure developing rollers 48, in which a stack of cut developer sheets 62 are stored. The uppermost developer sheet 62 is fed out by a semi-circular feed-out roller 64 and passes through a sheet guide path 66. The developer sheet 62 is brought into facial contact with the microcapsule sheet 28 and then passes through a nip between the pressure developing rollers 48. Pressure is imparted to the superposed sheets when passing between the pressure developing rollers 48. Unexposed microcapsules are ruptured and the chromogenic material released from the ruptured microcapsules reacts with the developer material coated on the developer sheet 62, with the result that a visible color image is formed on the developer sheet 62.

The developer sheet 62 is separated from the microcapsule sheet 28 after the pressure development is over and is fed into a nip between a thermal fixing rollers 68 where coloring of the image on the developer sheet 62 is thermally accelerated. Thereafter, the developer sheet 62 is discharged onto a tray 70 with the image face up.

Figure 2:
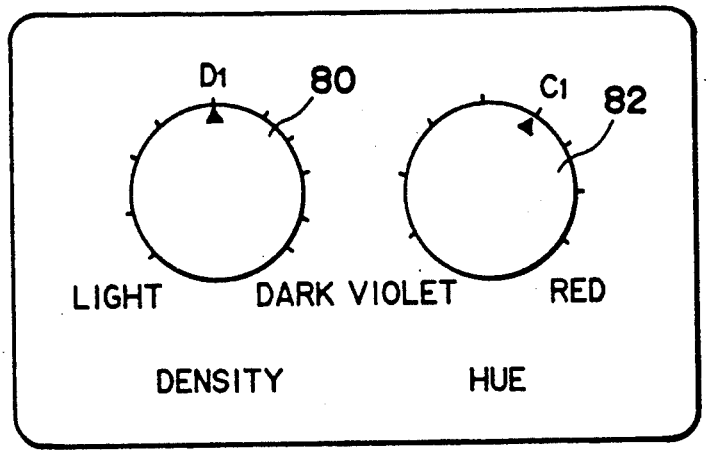
FIG. 2 is a plan view showing density and hue adjusting dials provided in the color copying machine shown in FIG. 1.

In the above-described color copying machine 10, in order to adjust the density and hue of the color image to be copied on the developer sheet 62, there is provided in the upper frame 16*a* a density adjusting dial 80 and a hue adjusting dial 82 such as shown in FIG. 2. These dials are calibrated to indicate adjustable ranges of the density and the hue, and are connected to the control unit 34 to output the selected density and hue. Once a user selects desired density and hue, the color copying machine of the present invention can automatically perform color copying in conformity with the selected density and hue.

Figure 4A:
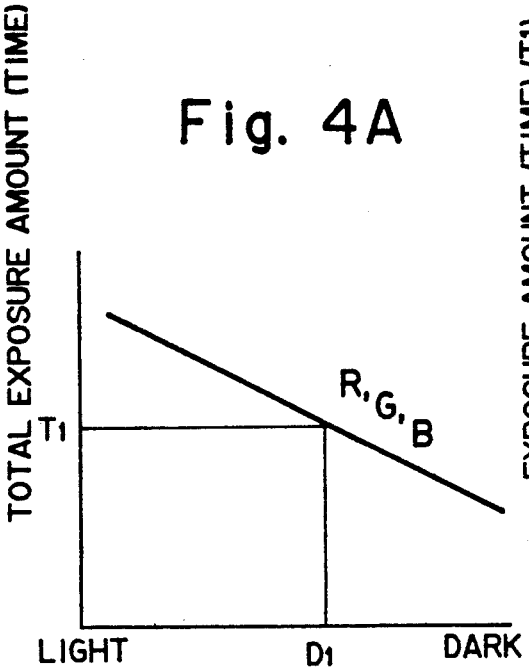
FIG. 4A is an explanatory diagram for description of a total exposure amount of red, green and blue vs. density.
Figure 4B:
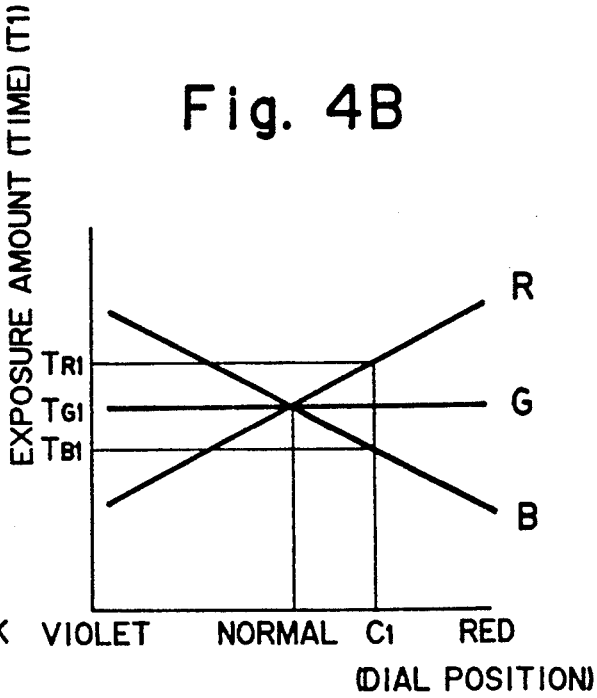
FIG. 4B is an explanatory diagram for description of a relation between hue and the exposure amounts of red, green and blue.
Figure 3:
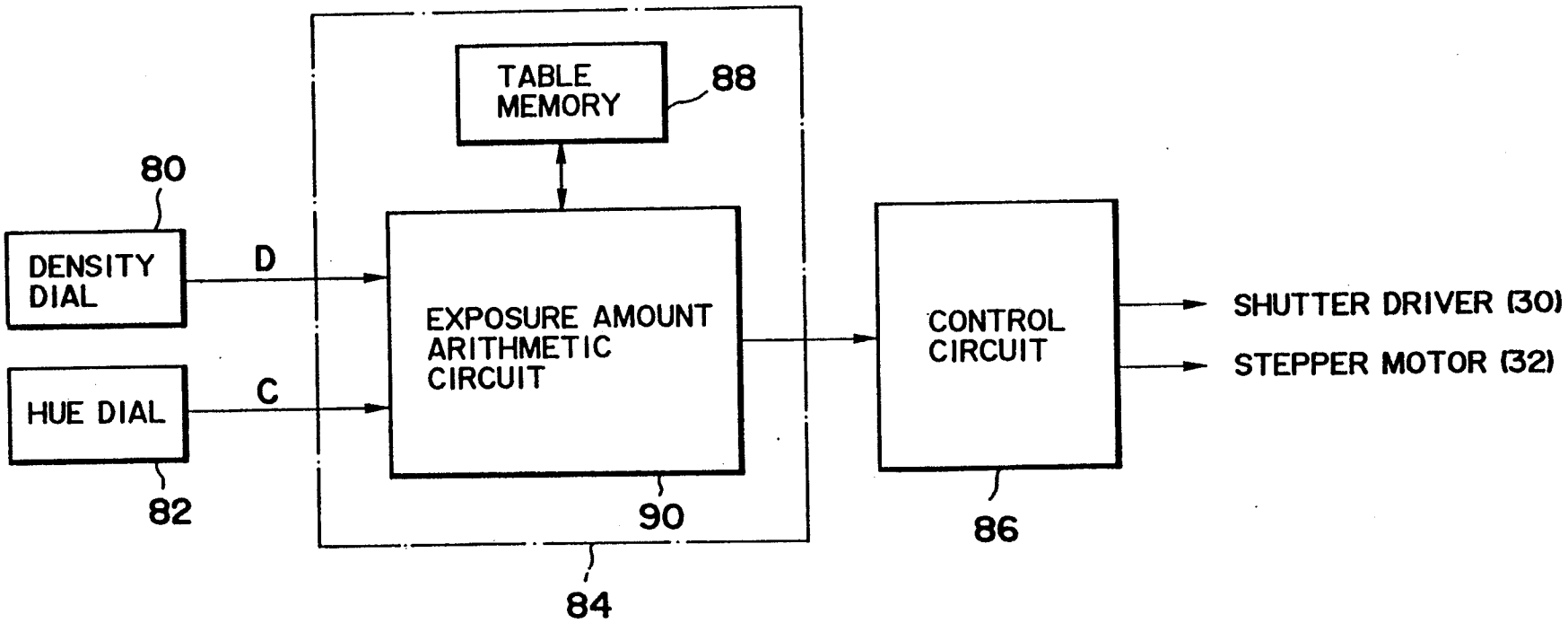
FIG. 3 is a block diagram showing one example of a color tone adjusting circuit used in the color copying machine shown in FIG. 1.

Referring to FIG. 3, there is shown a color tone adjusting circuit provided internally of the control unit 34. The circuit includes an exposure amount decision circuit 84 and an exposure amount control circuit 86. The exposure amount decision circuit 84 includes a table memory 88 and an exposure amount arithmetic circuit 90. In the table memory 88, as shown in FIG. 4A, there is stored information regarding a relation between total exposure amounts of red, green and blue lights and densities. The total exposure amounts have been stored in terms of time. As shown in FIG. 4*b*, there is further stored in the table memory 88 information regarding a relation between exposure amounts of each of red, green and blue lights and hues. The exposure amounts have further been stored in terms of time.

When the user selects desired density and hue by turning knobs of the corresponding dials, relevant exposure amount for each of red, green and blue to be applied to the microcapsule sheet 28 is computed by the arithmetic circuit 90 based on the information stored in the table memory 88. Based on the results of computation, the exposure amount control circuit 86 controls the shutter driver 30 and the stepper motor 32 so that the microcapsule sheet 28 is exposed to each of the lights for a period of time corresponding to the exposure amount determined with respect to each of three colors. The exposure amount applied to the microcapsule sheet 28 can be adjusted not only by controlling the duration in which the shutter is being opened but also by adjusting an amount of light emitted from the lamps 18, 18. Combination of the shutter control and the lamp control is also available.

Control of the exposure amount will be described far more in detail. Based on the density D set through the dial 80, the exposure amount arithmetic circuit 90 computes a total exposure amount T of the red, green and blue lights using a table shown in FIG. 4A. Based on the resultant total exposure amount computed, the exposure period of time for each of red, green and blue is next determined to agree with the hue C which has been set through the dial 82 while referring to the table shown in FIG. 4B. Representing the exposure periods of time for red, green and blue with TR, TG and TB, respectively, the following relation must be established.

$$T = TR + TG + TB$$

The resultant exposure periods of time for red, green and blue are sequentially fed to the control circuit 86. Based on the data thus fed from the exposure amount arithmetic circuit 90, the control circuit 86 controls the stepper motor 32 so that when the exposure is to be performed with, for example, a red wavelength light, the red filter segment 24R of the filter unit 24 is positioned below the lens 22. Thereafter, the control circuit 86 controls the shutter driver 30 to open the shutter 20 for a duration of TR, with the result that the microcapsule sheet 28 is exposed to the red wavelength light contained in the light reflected from the original document for the duration of TR and the red latent image is formed thereon.

Similarly, the control circuit 86 controls the stepper motor 22 to position the green filter segment 24 below the lens 22 and then controls the shutter driver 30 to open the shutter 20 for the duration of TG. Subsequently, the blue filter segment 24B is positioned below the lens 22 and the shutter 20 is opened for the duration of TB.

As a result, the microcapsule sheet 28 held on the exposure stand 26 is successively exposed to red, green and blue light components contained in the light reflected from the original document for the periods of time TR, TG and TB, respectively, and thus the red, green and blue latent images are superposely formed on the microcapsule sheet 28.

As described, according to the present invention, when the density adjusting dial 80 is set, for example, to D1, the total exposure time of the red, green and blue lights are set to T1 according to the table shown in FIG. 4A. If the dial 80 is turned to the "dark" direction, the exposure duration is shortened, with the result that the image reproduced tends to be dark as a whole. When, on the other hand, the dial 80 is turned to the "light" direction, the exposure duration is prolonged, with the result that the image reproduced tends to be light as a whole.

When the hue adjusting dial 82 is set to C1, the exposure periods of time TR1, TG1, TB1 for the red, green and blue wavelength lights are determined based on the table shown in FIG. 4B. The exposure period of time TG1 for the green wavelength light is not changed depending upon the set position of the hue adjusting dial 82 but only the exposure periods of time TR1, TB1 for the red and blue wavelength lights are changed. Depending upon the set position of the dial 80, the three lines in FIG. 4B are shifted upward or downward together. Thus, the exposure periods of time for red, green and blue can be adjusted as achieved by adjusting each exposure time independently of one another.

As described, only by setting the density D1 and the hue C1 through the two dials 80, 82, the exposure periods of time TR1, TG1 and TB1 for red, green and blue can automatically be determined. Therefore, the hue and density adjustments can be accomplished extremely simply in contrast to a conventional apparatus in which density for each of yellow, magenta and cyan is adjusted independently of one another.

Figure 5:
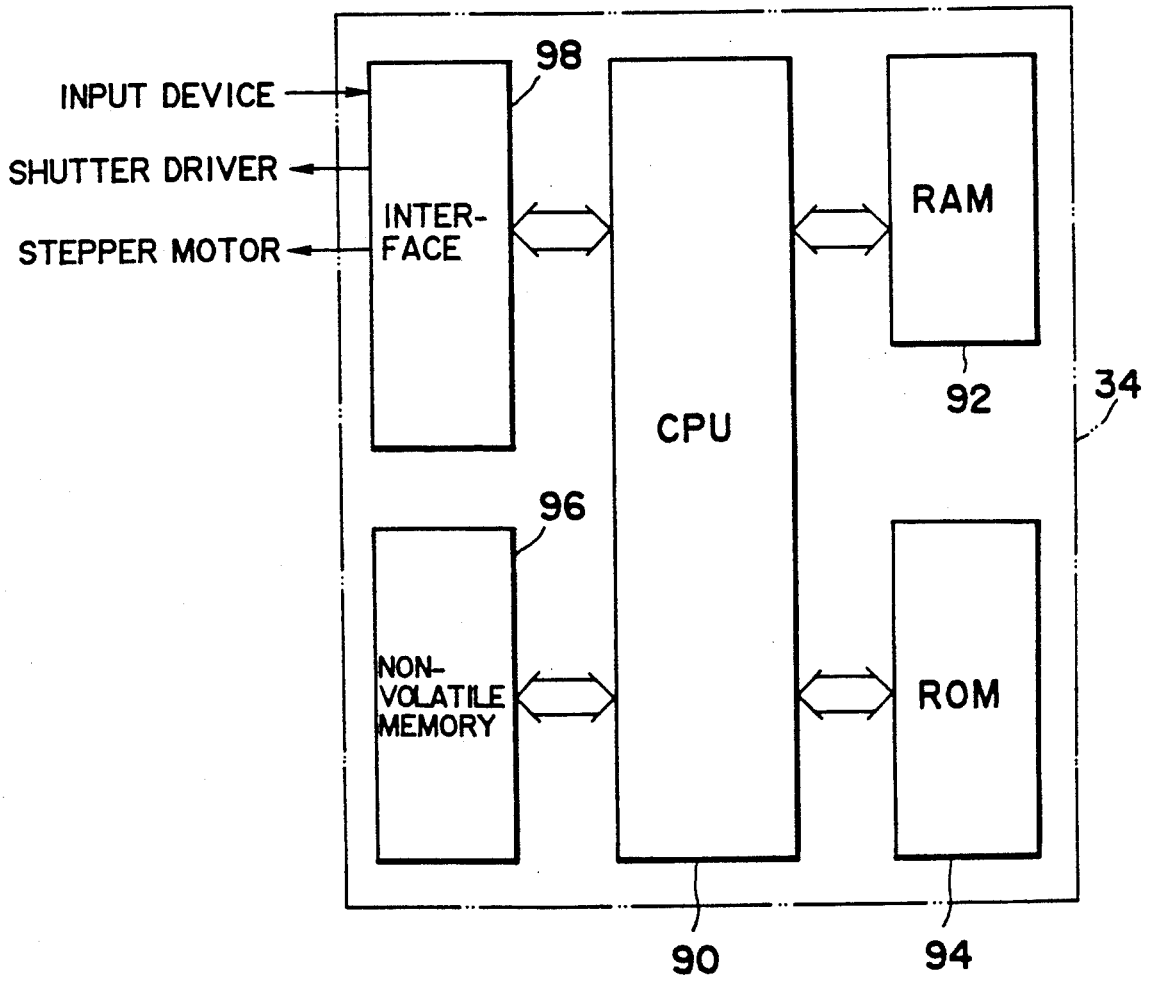
FIG. 5 is a block diagram showing a color tone adjusting circuit constructed by using a central processing unit.

The tone adjusting circuit shown in FIG. 3 can be implemented by the circuit shown in FIG. 5 which includes a central processing unit (CPU) 90, random access memory (RAM) 92, read-only memory (ROM) 94, a non-volatile memory 96 and an interface 98. The non-volatile memory 96 functions as the table memory 88. In the ROM 94, a program is stored, according to which the CPU is run to execute the processing of the tone adjusting circuit. In the RAM 92, data computed by the CPU 90 are temporarily stored. The interface 98 is provided for connecting the various kinds of input devices including the density adjusting dial 80 and the hue adjusting dial 80 to the CPU 90. The interface 98 is further connected to the shutter driver 30 and the stepper motor 32.

Color tone adjusting operation will next be described.

Before making a copy, the copy density is set, for example, to D1 with the density adjusting dial 80, and then the hue to, for example, C1 with the hue adjusting dial 82. Next, the cover 14 is opened to place the original document face down on the original support pane 12, and the cover 14 is closed. Then a start switch (not shown) is depressed, whereupon the light sources 18, 18 are lit to irradiate the light onto the image face of the original under the condition where the unexposed microcapsule sheet 28 has been held on the exposure stand 26.

The control unit 34 drives the stepper motor 32 to position the red filter segment 24R below the lens 22. The control unit 34 reads the dial values D1 and C1 and determines the exposure period of time TR1 for the red wavelength light which agrees with the density D1 and the hue C1 while referring to the tables shown in FIGS. 4A and 4B. Then, the control unit 34 controls the shutter driver 30 to open the shutter 20 for a period of time TR1, thereby allowing the red wavelength light contained in the light reflected from the original to be applied onto the microcapsule sheet 28. As a result, the cyan microcapsules are photo-cured and thus the red latent image is formed on the microcapsule sheet 28.

When the shutter 20 is closed after the exposure period of time TR1 has elapsed, the control unit 34 controls the stepper motor 32 so that the green filter segment 32 is positioned below the lens 22. Similar to the red light exposure, the control unit 34 determines the green exposure period of time TG1 based upon the dial set values of the density D1 and the hue C1. After the green exposure is finished, the blue filter segment 24B is positioned below the lens 22, the blue exposure period of time TB1 is determined, and the blue exposure is performed.

After the above-described processings are finished, the takeup shaft 50 is rotated to move the exposed region of the microcapsule 20 to the pressure developing rollers 48, 48. In timed relation with the rotations of the takeup shaft 50, the semi-circular roller 44 is rotated to feed the uppermost developer sheet 62 stacked in the cassette 60 and to superpose it on the exposed region of the microcapsule sheet 28. The superposed two sheets are fed into the nip between the pressure developing rollers 48, 48 and are pressed thereby. As a result, the latent image on the microcapsule sheet 28 is developed and transferred on the developer sheet 62. Thereafter, the developer sheet 62 is thermally fixed by the thermal roller 68 and discharged onto the tray 70.

As described above, according to this embodiment, only by adjusting the density and the hue through the respective dials, a copy of a desired color tone is obtained.

Next, the color copying machine according to a second embodiment of the present invention will be described while referring to FIGS. 6 through 10, in which like or corresponding components are designated by like or corresponding reference numerals.

Figure 6:
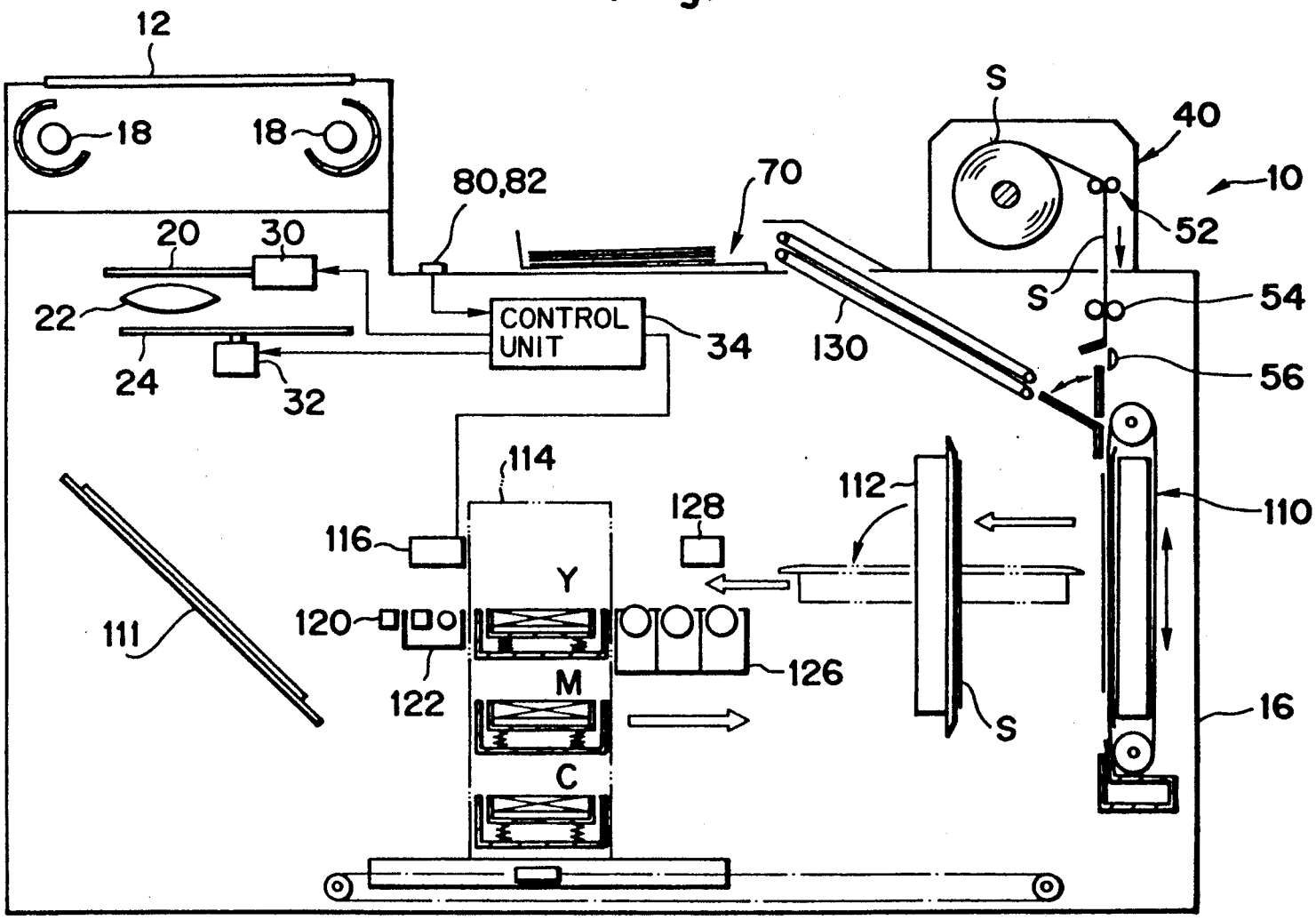
FIGS. 6 and 7 are vertical cross-sectional views showing a color copying machine in which a color copying is performed using an electrofax technique.

FIG. 6 shows a color copying machine 10 which makes color copies according to an electrofax technique. In this machine 10, a photosensitive sheet S is used as a recording medium, which is made up of an electroconductive substrate and a photoconductive layer deposited on the substrate. The photoconductive layer is made up of a mixture of titanium dioxide ($TiO_2$) and a binding material. This photosensitive sheet S is drawn downwardly out of a casing 40 by the feed rollers 52, 54. The casing 40 is provided above the upper frame. When the photosensitive sheet S is drawn an appropriate length, a paper cutter 56 is rotated to cut the photosensitive sheet S. The cut photosensitive sheet S is temporarily retained on a conveyor belt 110 by an appropriate means and is transferred onto a paper stage 112. The paper stage 112 moves leftwardly and when reaches to a predetermined position, whereupon it rotates in the counter-clockwise direction to be oriented horizontally. At this time, the photosensitive sheet S is retained on the upper surface of the paper stage 112.

Figure 7:
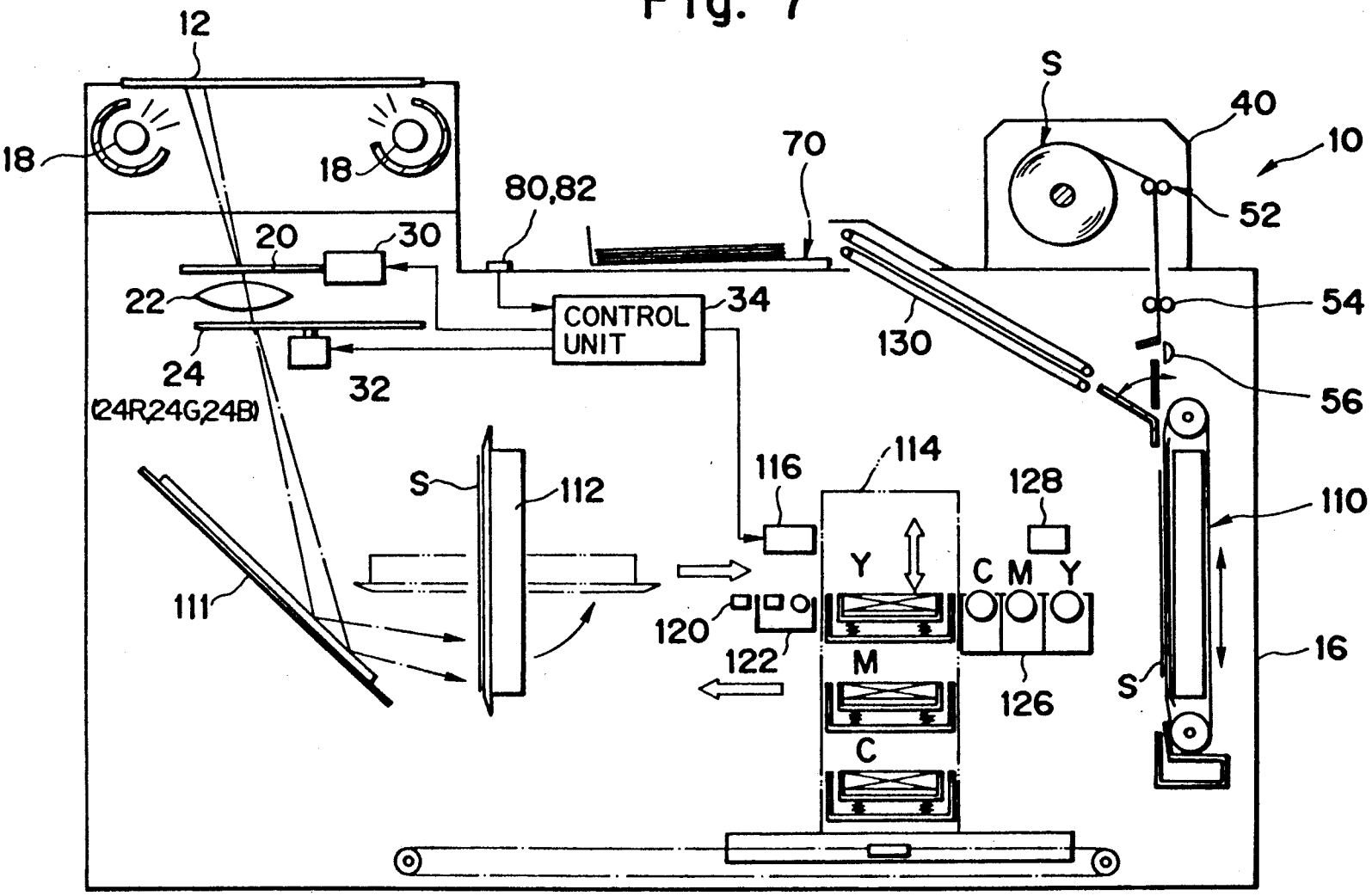

Subsequently, the paper stage 112 and a tank unit 112 are simultaneously moved toward each other, i.e. the paper stage 112 moves leftwardly and the tank unit 112 moves rightwardly. During the movement, the paper stage 112 and the tank unit 112 cross on their way and stop in the positions where their original positions are replaced, as shown in FIG. 7. When the paper stage 112 crosses the tank unit 112, the photosensitive sheet S is precharged to negative polarity by the operation of a scorotron 116. The paper stage 112 is then rotated counter-clockwise by 90 degrees to a position indicated by a solid-line where the photosensitive sheet S is subjected to exposure.

In this condition, a control unit 34 controls a shutter driver 30 and a stepper motor 32 to select a blue filter segment 24B and to allow the light emanated from the light sources 24, 24 and reflected from the original document to pass through a shutter 20. As a result, the blue light component contained in the light reflected from the original is applied onto the photosensitive sheet S for a period of time TB1 during which the shutter 20 is being opened by the actuation of a shutter driver 30, thereby forming an electrostatic latent image on the photosensitive sheet S. After the exposure, the paper stage 12 is again rotated counterclockwise by 90 degrees to be oriented horizontally as shown by two-dotted chain line in FIG. 7, in which the photosensitive sheet S is held in down side.

Thereafter, the paper stage 112 and the tank unit 114 are simultaneously moved toward each other to cross each other as indicated by the arrows in FIG. 7. At this time, the photosensitive sheet S is exposed to light using an auxiliary exposure unit 120, the light amount from which has been controlled by the control unit 120, so that an amount of electric charges on the entire photosensitive sheet S is adjusted. Prior to development of the photosensitive sheet S, the sheet S having a highly porous surface is immersed into a solvent contained in a pre-wet unit 122, which solvent is the same as that contained in the developing liquid. The photosensitive sheet S is then subjected to wet development with yellow toner contained in a developing unit Y provided internally of the tank unit 114. The developing bias of the developing unit Y is also adjusted by the control unit 34. The yellow toner excessively deposited on the developed photosensitive sheet S is removed by a squeeze roller 126 provided in association with the developing unit Y.

After a series of developing steps are terminated, the positions of the paper stage 112 and the tank unit 114 are again replaced from each other so as to be a positional relationship shown in FIG. 6. The paper stage 112 is rotated by 180 degrees in which the photosensitive sheet S carrying the yellow image is retained face up.

Upon completion of the yellow image reproduction, the reproduction of magenta image is performed in the similar fashion with the exception that prior to charging the photosensitive sheet S by the scorotron 116, the electric charges on the photosensitive sheet S are removed by the corotron 128. After that, the photosensitive sheet S is uniformed charged similar to the case of reproducing the yellow image, the sheet S is then exposed to green light and is developed by the magenta toner. Similarly, the cyan image is formed thereon and, as a result, a full color image is formed on the photosensitive sheet S.

The paper stage 112 then rotates and is brought to a position indicated by a solid line in FIG. 6. The photosensitive sheet S carrying the full color image is transferred onto the conveyor belt 110. With the conveyor belts 110 and 130, the sheet S is discharged onto a discharge tray 70 provided in the upper portion of the frame 16*a* with the image face up.

Figure 8:
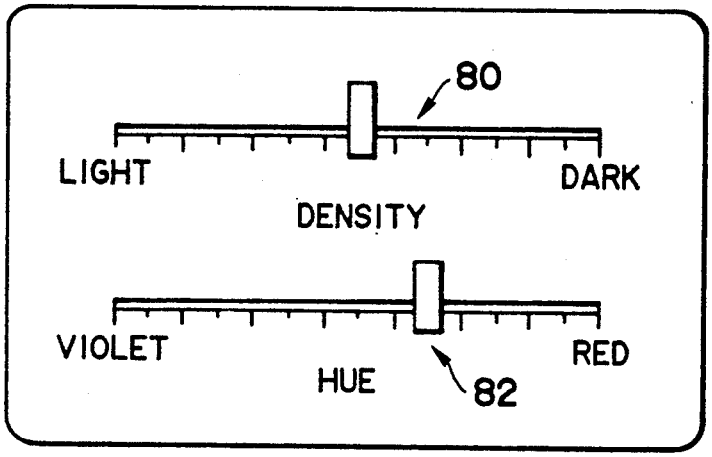
FIG. 8 is a plan view showing density and hue adjusting dials provided in the color coping machine shown in FIGS. 6 and 7.

In order to adjust the density and hue of the full color image, a density adjusting volume 80 and a hue adjusting volume 82 are provided in the upper portion of the frame 16*a* as shown in FIG. 8. The set values by these volumes are fed to the control unit 34.

Figure 9:
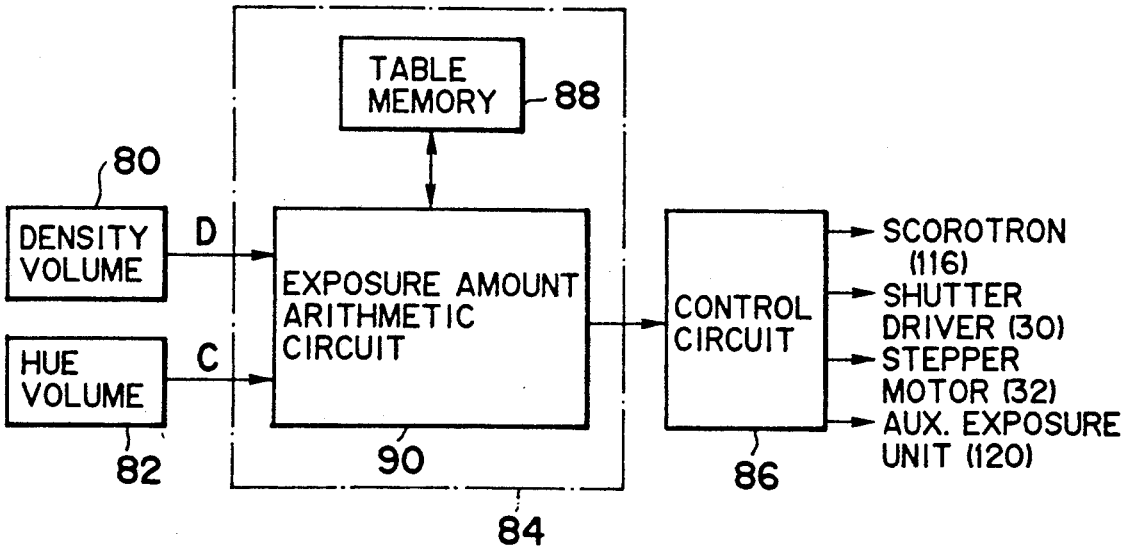
FIG. 9 is a block diagram showing a color tone adjusting circuit used in the circuit shown in FIGS. 7 and 8.
Figure 10A:
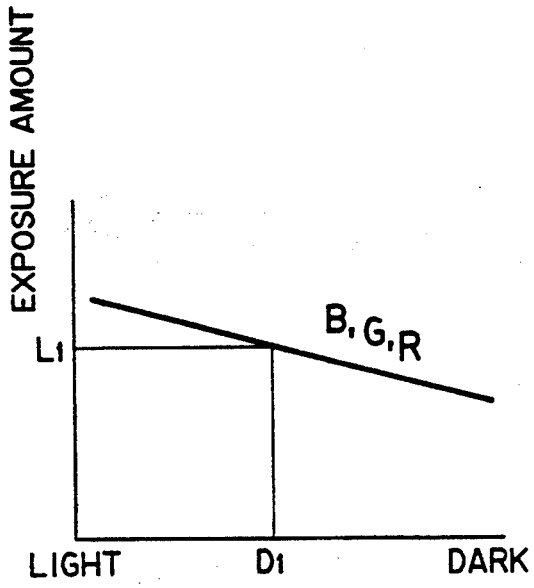
FIG. 10 is an explanatory diagram for description of the respective tables stored in a table memory shown in FIG. 9.
Figure 10B:
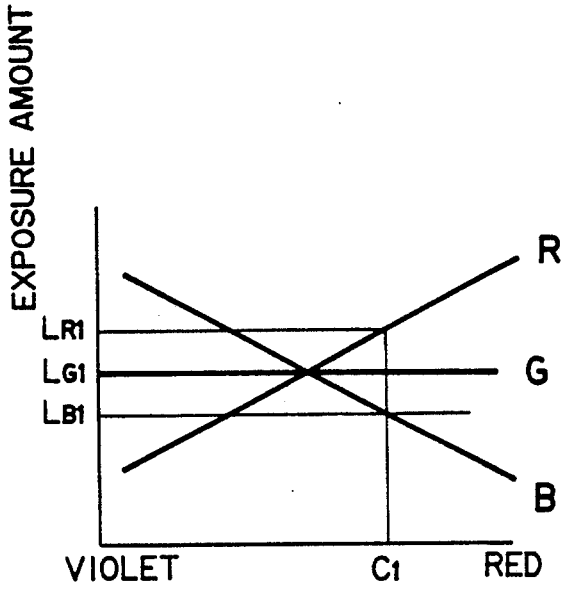
Figure 10C:
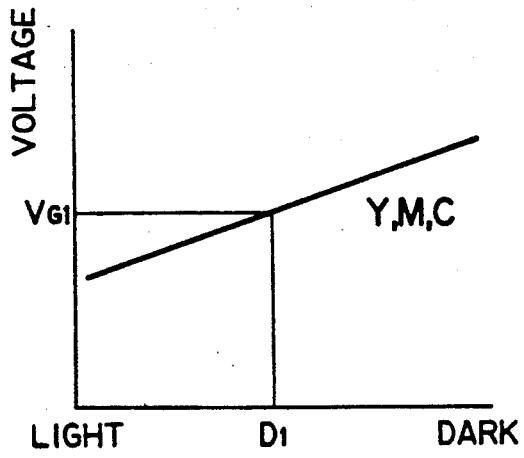
Figure 10D:
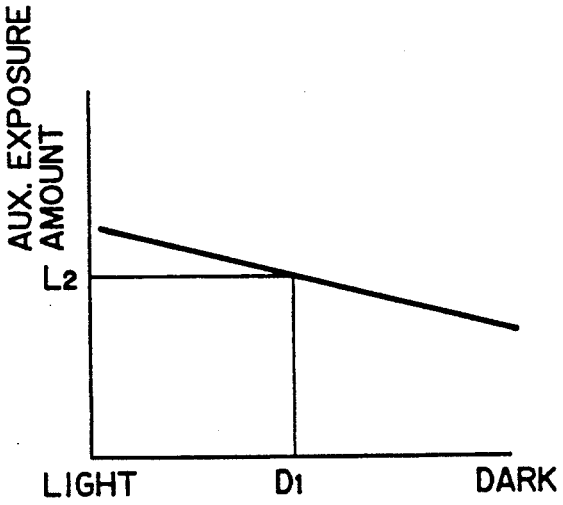

FIG. 9 shows a color adjustment control circuit provided interiorly of the control unit 34. A table memory 88 stores in advance four tables shown in FIGS. 10A through 10D. The tables shown in FIGS. 10A and 10B are identical to those shown in FIGS. 4A and 4B, respectively. Therefore, duplicate description thereof is omitted herein. The table shown in FIG. 10C indicates a relationship between grid voltages Vg of the scorotron 116 and the densities. In this embodiment, this relation has been measured in advance and is stored in the table memory 88. The table shown in FIG. 10*d* indicates a relation between the exposure amounts by the auxiliary exposure unit 120 and the exposure period of time of each of the lights. This relation has also been measured in advance and is stored in the table memory 88 as well.

In accordance with the respective tables stored in the table memory 88, the exposure amount arithmetic circuit 90 determines not only the respective exposure amounts of red, green and blue lights to agree with the density D and the hue C set by the dials 80, 82 but also the grid voltage Vg of the scorotron 116 and the auxiliary exposure amount by the auxiliary exposure unit 120. Based on the thus determined values, the control unit 86 controls the shutter driver 30, the stepper motor 32, the corotron 128 and the auxiliary exposure unit 120, with the result that a full color image meeting the density and the hue as set is formed on the photosensitive sheet S.

For example, when the density is set to D1 and the hue is set to C1 through the volumes 80 and 82, the exposure amounts for red, green and blue lights, LR1, LG1 and LB1 are determined based on the respective tables shown in FIG. 10, and the auxiliary exposure amount L2 and the grid voltage Vgl are also automatically determined. Based on the values thus determined, the associated circuits are controlled by the control unit 34, whereupon the yellow image is initially formed on the photosensitive sheet S, the magenta image is subsequently formed thereon and the cyan image is finally formed thereon.

As described above, according to the color copying machine of the present invention, a full color image is reproduced on the photosensitive sheet S only by setting the density and the hue through the volumes 80 and 82.

Although the present invention has been described with reference to specific embodiments, it would be apparent for those skilled in the art that a variety of changes and modifications may be made without departing from the scope and spirit of the invention. For example, in the first embodiment of the invention, the position on the dials 80 and 82 and the exposure periods of time are depicted as being linearly related to each other as shown in FIGS. 4 and 10. However, these parameters may be in a non-linear relation, such as a relation depicted by a prescribed curve, if desirable. Further, depending on the position of the density adjusting dial 80, the red and blue lights may be changed differently The exposure may be performed by yellow, magenta and cyan lights in place of the blue, green and red lights. Further, the exposure amount does not necessarily be controlled in terms of exposure period of time but may be controlled by varying the amount of light emanated from the light source or by adjusting a transmission ratio of the filter.

In the second embodiment, the positions of the dials 80, 82 and the grid voltage and the auxiliary exposure amount are in a linear relation, they can be changed to a non-linear relation. Further, the grid voltage Vg and the auxiliary exposure amount L may be set to constant levels with respect to three colors. The grid voltage table and the auxiliary exposure amount table may be provided to each of the colors, and the grid voltage and the auxiliary exposure amount may be set from the data stored in the table. In addition, the exposure amount for red, green and blue may be determined by a hardware arrangement so that the exposure amounts for red, green and blue are outputted directly.

While the present invention has been described with reference to color copying machines, the present invention is also applicable to a color laser printer, a color ink jet printer or the like. When the present invention is applied to those printers, color adjustment can be extensively adjusted if contrast is further adjusted.

As described, according to the present invention, an exposure amount for each of red, green and blue can be automatically set only by setting the density and the hue. Therefore, the color tone of the image to be reproduced can be readily adjusted even if the user is not accustomed with the color adjustment.

What is claimed is:

1. A color image recording apparatus for recording a color image, the apparatus comprising a photosensitive recording medium exposed to at least two light components differing in wavelength to superposedly form a latent image thereon the latent image developed to provide the color image having a hue and a density, the hue of the color image being varied depending on an exposure amount by each of the light components and the density of the color image being varied depending on a total exposure amount by the light components, the apparatus comprising:

means for selecting a hue from a first variable range and means for selecting a density from a second variable range;

storage means for storing information regarding exposure amounts of each of the light components relative to hues in the first variable range and densities in the second variable range;

means for automatically determining an exposure amount for all of the light components corresponding to the hue and the density selected by said selecting means according to the information stored in said storage means; and control means responsive to the exposure amount determined by said determining means for controlling the exposure amount of each of the light components applied to the photosensitive recording medium.

2. A color image recording apparatus according to claim 1, wherein the photosensitive recording medium is exposed to light components having wavelengths corresponding to red, green and blue.

3. A color image recording apparatus according to claim 2, wherein said storage means comprises a first table memory storing first information regarding a relation between a total exposure amount of the light components applied to the photosensitive recording medium and the densities in the second variable range, and a second table memory storing second information regarding a relation between the exposure amount of each of the light components and the hues in the first variable range.

4. A color image recording apparatus according to claim 3, wherein said determining means determines the exposure amount for the light components based on the first and second information so that the total exposure amount determined based on the first information is equal to the sum of the exposure amounts of the light components determined based on the second information.

5. A color image recording apparatus according to claim 1, wherein the photosensitive recording medium comprises a substrate having a surface coated with microcapsules separately encapsulating chromogenic materials selectively procured by the light components differing in wavelength.

6. A color image recording apparatus according to claim 1, wherein the photosensitive recording medium comprises an electroconductive substrate and a photosensitive layer deposited on said substrate, said photosensitive layer comprising a mixture of titanium dioxide and a binding agent.

7. A color image recording apparatus according to claim 6, further comprising means for electrically charging the photosensitive recording medium, an amount of the electrical charges on the photosensitive recording medium being varied by the control means, and means for auxiliary exposing the photosensitive recording medium to light to adjust the amount of the electrical charges on the photosensitive recording medium, the amount of the electrical charges thereon being adjusted by the control means.

8. A color image recording apparatus according to claim 7, wherein said electrically charging means is applied with a voltage, the amount of the electrical charges on the photosensitive recording medium being varied in response to the voltage applied to said electrically charging means, and said auxiliary exposing means applies a variable amount of light onto the photosensitive recording medium, and wherein said storage means comprises a first table memory storing first information regarding a relation between a total exposure amount of the light components applied to the photosensitive recording medium and the densities in the second variable range, a second table memory storing second information regarding a relation between the storing second information regarding a relation between the exposure amount of each of the light components and the hues int the first variable range, third information regarding a relation between the voltage applied to said electrically charging means and the densities in the second variable range, and fourth information regarding a relation between the variable amount of light and the densities in the second variable range.

9. A color image recording apparatus for recording a color image, the apparatus comprising a photosensitive recording medium exposed to at least two light components differing in wavelength to superposedly form a latent image thereon, the latent image developed to provide the color image having a hue and a density, the hue of the color image being varied depending on an exposure amount by each of the light components and the density of the color image being varied depending on a total exposure amount by the light components;

first selecting means for selecting a hue from a first variable range;

second selecting means for selecting a density from a second variable range;

storage means for storing information regarding exposure amounts of each of the light components relative to hues in the first variable range and densities in the second variable range, said storage means comprising a first table memory storing first information regarding a relation between a total exposure amount of the light components applied to the photosensitive recording medium and the densities in the second variable range, and a second table memory storing second information regarding a relation between the exposure amount of each of the light components and the hues in the first variable range;

means for automatically determining an exposure amount for all of the light components corresponding to the hue and the density respectively selected by said first and second selecting means according to the information stored in said storage means; and control means responsive to the exposure amount determined by said determining means for controlling the exposure amount of each of the light components applied to the photosensitive recording medium.

10. A color image recording apparatus for recording a color image, the apparatus comprising a photosensitive recording medium exposed to at least two light components differing in wavelength to superposedly form a latent image thereon, the latent image developed to provide the color image having a hue and a density, the hue of the color image being varied depending on an exposure amount by each of the light components and the density of the color image being varied depending on a total exposure amount by the light components;

first selecting means for selecting a hue from a first variable range;

second selecting means for selecting a density from a second variable range;

storage means for storing information regarding exposure amounts of each of the light components relative to hues in the first variable range and densities in the second variable range;

means for automatically determining an exposure amount for all of the light components corresponding to the hue and the density respectively selected by said first and second selecting means according to the information stored in said storage means;

control means responsive to the exposure amount determined by said determining means for controlling the exposure amount of each of the light components applied to the photosensitive recording medium;

exposure means for exposing the photosensitive recording medium to the light components to form a latent image thereon; and developing means for developing the latent image to provide a color image, whereby the color image has the hue and density substantially equal to those selected by said first and second selecting means.

11. A color image recording apparatus according to claim 10, wherein the photosensitive recording medium is exposed to light components having wavelengths corresponding to red, green and blue.

12. A color image recording apparatus according to claim 11, wherein said storage means comprises a first table memory storing first information regarding a relation between a total exposure amount of the light components applied to the photosensitive recording medium and the densities in the second variable range, and a second table memory storing second information regarding a relation between the exposure amount of each of the light compounds and the hues in the first variable range.

13. A color image recording apparatus according to claim 12, wherein said determining means determines the exposure amount for the light components based on the first and second information so that the total exposure amount determined based on the first information is equal to the sum of the exposure amounts of the light components determined based on the second information.

14. A color image recording apparatus according to claim 10, wherein the photosensitive recording medium comprises a substrate having a surface coated with microcapsules separately encapsulating chromogenic materials selectively photocured by the light components differing in wavelength.

15. A color image recording apparatus according to claim 10, wherein the photosensitive recording medium comprises an electroconductive substrate and a photosensitive layer deposited on said substrate, said photosensitive layer comprising a mixture of titanium dioxide and a binding agent.

16. A color image recording apparatus according to claim 15, further comprising means for electrically charging the photosensitive recording medium, an amount of the electrical charges on the photosensitive recording medium being varied by the control means, and means for auxiliary exposing the photosensitive recording medium to light to adjust the amount of the electrical charges on the photosensitive recording medium, the amount of the electrical charges thereon being adjusted by the control means.

17. A color image recording apparatus according to claim 16, wherein said electrically charging means is applied with a voltage, the amount of the electrical charges on the photosensitive recording medium being varied in response to the voltage applied to said electrically charging means, and said auxiliary exposing means applies a variable amount of light onto the photosensitive recording medium, and wherein said storage means comprises a first table memory storing first information regarding a relation between a total exposure amount of the light components applied to the photosensitive recording medium and the densities in the second variable range, a second table memory storing second information regarding a relation between the exposure amount of each of the light components and the hues in the first variable range, third information regarding a relation between the voltage applied to said electrically charging means and the densities in the second variable range, and fourth information regarding a relation between the variable amount of light and the densities in the second variable range.

* * * * *